US006796824B2

(12) United States Patent
Dewitt et al.

(10) Patent No.: US 6,796,824 B2
(45) Date of Patent: Sep. 28, 2004

(54) SEALED IEC ELECTRICAL CONNECTOR ASSEMBLY

(75) Inventors: Donald E. Dewitt, Syracuse, IN (US); John W. Burwell, Rome City, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/273,466

(22) Filed: Oct. 18, 2002

(65) Prior Publication Data

US 2004/0077203 A1 Apr. 22, 2004

(51) Int. Cl.[7] ..... H01R 13/15

(52) U.S. Cl. ..... 439/271

(58) Field of Search ..... 439/271, 374, 439/106

(56) References Cited

U.S. PATENT DOCUMENTS

| | | | | |
|---|---|---|---|---|
| 6,227,883 | B1 * | 5/2001 | Lee et al. | 439/106 |
| 6,558,178 | B2 * | 5/2003 | Nakamura | 439/271 |
| 6,558,180 | B2 * | 5/2003 | Nishimoto | 439/282 |
| 6,582,242 | B2 * | 6/2003 | Murakami et al. | 439/271 |
| 6,599,144 | B1 * | 7/2003 | Schumann et al. | 439/271 |

* cited by examiner

*Primary Examiner*—Gary Paumen
(74) *Attorney, Agent, or Firm*—Taylor & Aust. P.C.

(57) ABSTRACT

An electrical connector assembly includes a first connector and a second connector. The first connector has a male portion with a peripheral outer wall conforming to the IEC 320 standard. The male portion includes a plurality of first electrical terminals. The second connector has a female portion with a peripheral inner wall conforming to the IEC 320 standard. The female portion includes a plurality of second electrical terminals mateable with the first electrical terminals. The male portion and/or female portion include at least one seal, with each seal being a radial seal or an axially facing seal.

13 Claims, 2 Drawing Sheets

SEALED IEC ELECTRICAL CONNECTOR ASSEMBLY

BACKGROUND OF THE INVENTION

1. Field of the Invention

The present invention relates to electrical connectors, and, more particularly, to electrical connectors conforming to the IEC 320 international standard for inlet and outlet connectors.

2. Description of the Related Art

Electrical power inlet connectors and power outlet connectors provide electrical power to and from an electrical distribution circuit. A manufacturer may anticipate selling power inlet and power outlet connectors in multiple different countries. Under such circumstances, it is most convenient and economical to manufacture the power inlet/outlet connector in conformance with one or more international standards adopted by multiple different countries in which the connector is targeted to be marketed. The International Electrotechnical Commission (IEC) is an organization which sets international standards for electrical components in all fields of electrotechnology. For power inlet/outlet connectors, the IEC has promulgated the IEC 320 standard setting forth basic conformance requirements. Information on IEC standards may be found at the internet website www.iec.ch, which is incorporated herein by reference. IEC 320 connectors may be provided with a multiplicity of mounting and termination configurations, and may also be fused or include voltage selectors (e.g., such as 115 volts or 600 volts).

IEC 320 power inlet/outlet connectors may be used in multiple different environments. For basically static ambient environments, such as an office environment, a conventional IEC 320 connector works fine. However, it may also be necessary or desirable to utilize an IEC 320 inlet/outlet connector in a harsher environment, such as a power inlet connector to a refrigeration or freezer unit in which misting occurs to keep food products fresher for a longer period of time.

What is needed in the art is an electrical connector assembly conforming to the IEC 320 standard which may be used in wet or humid environments.

SUMMARY OF THE INVENTION

The present invention provides IEC 320 power inlet/outlet connectors including one or more seals for sealing between the mating electrical connectors so that the connectors may be utilized in harsher environments. The IEC 320 connectors conform to the IEC 320 standards, with multiple different mounting configurations and termination configurations being possible. The inlet/outlet connectors preferably include redundant seals, with an axial seal on the end of one of the connectors and a radial seal around the radial periphery of the connector. The redundant seals may be on the same connector, or one seal may be provided on one connector and the other seal on the mating connector. In this manner, a hermetically sealed electrical connector assembly conforming to the IEC 320 standard may be utilized within harsher ambient environments.

The invention comprises, in one form thereof, an electrical connector assembly including a first connector and a second connector. The first connector has a male portion with a peripheral outer wall conforming to the IEC 320 standard. The male portion includes a plurality of first electrical terminals. The second connector has a female portion with a peripheral inner wall conforming to the IEC 320 standard. The female portion includes a plurality of second electrical terminals mateable with the first electrical terminals. The male portion and/or female portion include at least one seal, with each seal being a radial seal or an axially facing seal.

An advantage of the present invention is that the IEC 320 connector assembly of the present invention is sealed from the ambient environment.

Another advantage is that multiple seal configurations on the male connector and/or female connector are possible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
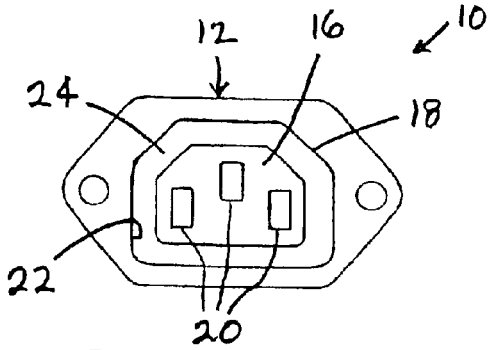
FIGS. 1 and 2 are an end view and top view, respectively, of a pair of mating electrical connectors of the present invention.
Figure 2:
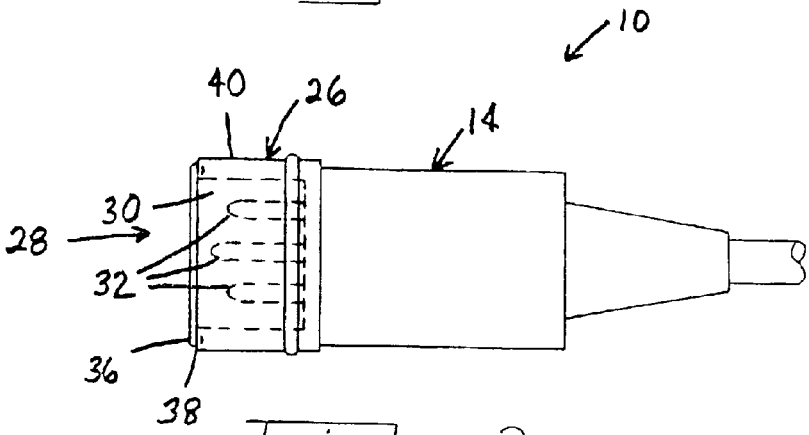

Referring now to the drawings, and more particularly to FIGS. 1 and 2, there is shown an embodiment of electrical connector assembly 10 of the present invention, including a first connector 12 and a second connector 14. First connector 12 includes a male portion 16 with a peripheral outer wall 18 conforming to the IEC 320 standard. Male portion 16 includes a plurality of first electrical terminals in the form of female electrical terminals 20. A peripheral wall surrounds male portion 16 and defines a recess 24 therebetween.

Second connector 14 includes a shroud 26 defining a female portion 28 with a peripheral inner wall 30 conforming to the IEC 320 standard. Female portion 28 recieves male portion 16 therein such that peripheral outer wall 18 is adjacent peripheral inner wall 30. Shroud 26 is received in recess 24 of first electrical connector 12. Female portion 28 includes a plurality of second electrical terminals in the form of male electrical terminals 32 which mate with female electrical terminals 20.

According to an aspect of the present invention, first electrical connector 12 and/or second electrical connector 14 are provided with one or more seals for sealing from the ambient environment. More particularly, in the embodiment of electrical connector assembly 10 shown in FIGS. 1 and 2, shroud 26 includes both a radial seal 34 and an axially facing seal 36. Axially facing seal 36 is positioned at the axial end face 38 of shroud 26. The combined axial length of shroud 26 and axially facing seal 36 is configured such that axial facing seal 36 engages with and seals at the bottom of recess 24. Radial seal 34 is carried by an outer wall 40 of shroud 26 at the end opposite from axial end face 38. Radial seal 34 is configured so as to seal against peripheral wall 22 when shroud 26 is received within recess 24.

Figure 3:
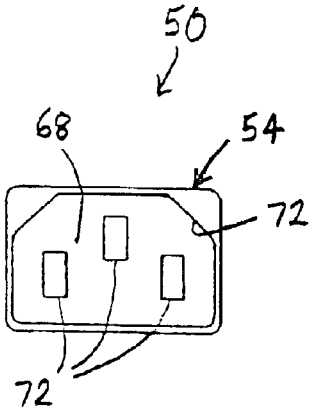
FIGS. 3 and 4 are an end view and side view, respectively, of another pair of mating electrical connectors of the present invention.
Figure 4:
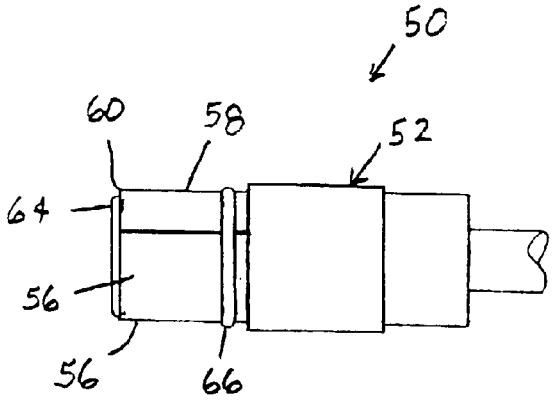

Referring now to FIGS. 3 and 4, there is shown another embodiment of an electrical connector assembly 50 of the present invention including a first electrical connector 52 and a second electrical connector 54. First electrical connector 52 includes a male portion 56 with a peripheral outer wall 58 conforming to the IEC 320 standard. Male portion 56 also includes an axial end face 60 having a plurality of female electrical terminals 62 therein. Axial end face 60 carries an axially facing seal 64. Outer wall 58 carries a radial seal 66 at an end opposite from axial end face 60. Second electrical connector 54 includes a female portion 68 with a peripheral inner wall 70. A plurality of male electrical terminals 72 are disposed within female portion 68 surrounded by inner wall 70.

Figure 5:
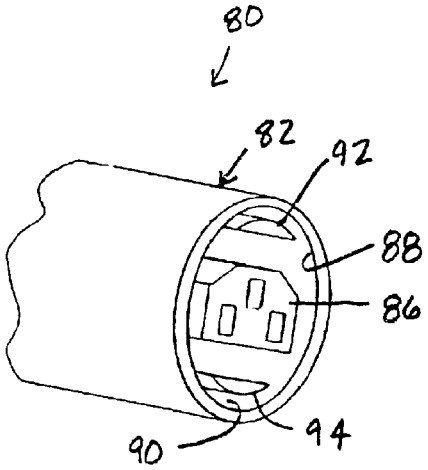
FIGS. 5 and 6 are an end view and side view, respectively, of yet another pair of mating electrical connectors of the present invention.
Figure 6:
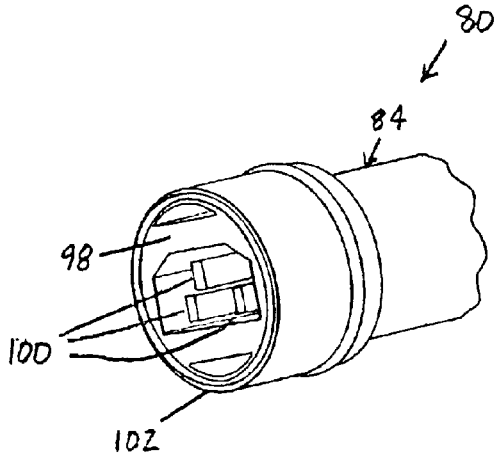

Referring now to FIGS. 5 and 6, there is shown another embodiment of an electrical connector assembly 80 of the present invention, including a first electrical connector 82 and a second electrical connector 84. First electrical connector 82 includes a male portion 86 conforming to the IEC 320 standard, similar to male portion 16 shown in FIG. 1. A peripheral wall 88 surrounds male portion 86 and defines a recess 90 therebetween. A keying arrangement including male keys 92 and 94 provides keyed engagement with second electrical connector 84.

Second electrical connector 84 includes a shroud 96 defining a female portion 98 in which male electrical terminals 100 are disposed. Shroud 96 provides generally the same functionality as shroud 26 shown in FIG. 2. For example, shroud 96 carries an axially facing seal 102 and a radial seal 104. However, shroud 96 has a circular cross-section configured to fit within circular recess 90 of first electrical connector 82.

Figure 7:
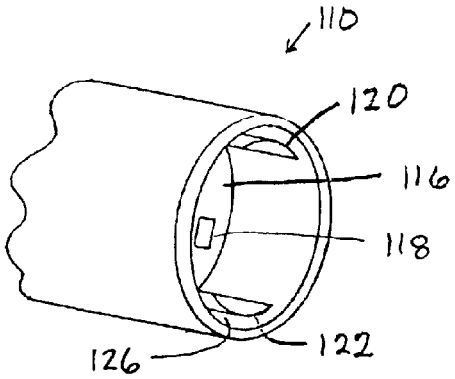
FIGS. 7 and 8 are an end view and side view, respectively, of still another pair of mating electrical connectors of the present invention.
Figure 8:
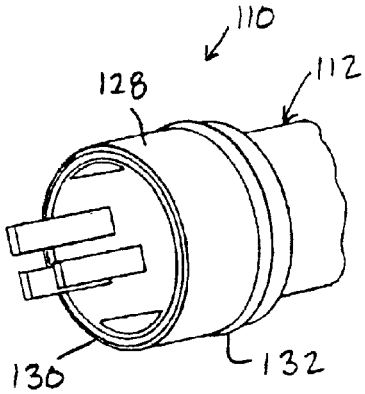

Referring now to FIGS. 7 and 8, there is shown yet another embodiment of an electrical connector assembly 110, including a first electrical connector 112 and a second electrical connector 114. Second electrical connector 114 includes a female portion 116 with a plurality of female electrical terminals 118 disposed therein. Keys 120 and 122 are in the form of male projections. A peripheral wall 124 defines a circular recess 126 surrounding female portion 116 and keys 120, 122.

First electrical connector 112 includes an outer wall 128 which fits into circular recess 126 on second electrical connector 114. Outer wall 128 carries an axially facing seal 130 and a radial seal 132 which are configured to sealingly engage with the bottom of recess 126 and the inside diameter of peripheral wall 124, respectively. Correspondingly shaped recesses in the end of first electrical connector 112 receive keys 120 and 122.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical connector assembly, comprising:

a first electrical connector having a male portion with a peripheral outer wall conforming to the IEC 320 standard, said male portion including a plurality of first electrical terminals; and a second electrical connector having a female portion with a peripheral inner wall conforming to the IEC 320 standard, said female portion of said second connector releasably receiving said male portion of said first connector, said female portion including a plurality of second electrical terminals mateable with said first electrical terminals;

wherein at least one of said male portion and said female portion includes at least one seal, each said seal being one of a radial seal and an axially facing seal.

2. The electrical connector assembly of claim 1, said male portion including an axial end face, and at least one of a radial seal carried by said outer wall, and an axially facing seal carried by said end face.

3. The electrical connector assembly of claim 2, said male portion including both a radial seal carried by said outer wall and an axially facing seal carried by said end face.

4. The electrical connector assembly of claim 2, said male portion including a radial seal carried by said outer wall at an end Opposite from said axial end face.

5. An electrical connector assembly comprising:

a first electrical connector having a male portion with a peripheral outer wall conforming to the IEC 320 standard, said male portion including a plurality of first electrical terminals; and a second electrical connector having a female portion with a peripheral inner wall conforming to the IEC 320 standard, said female portion including a plurality of second electrical terminals mateable with said first electrical terminals;

wherein at least one of said male portion and said female portion includes at least one seal, each said seal being one of a radial seal and an axially facing seal, said female portion including an axial end face, and at least one of a radial seal carried by said inner wall, and an axially facing seal carried by said end face.

6. The electrical connector assembly of claim 1, wherein said first electrical terminals comprise female electrical terminals.

7. The electrical connector assembly of claim 1, wherein said second electrical terminals comprise male electrical terminals.

8. The electrical connector assembly of claim 1, wherein said first connector includes a peripheral wall surrounding said male portion, said peripheral wall and said male portion defining a recess therebetween.

9. An electrical connector assembly comprising:

a first electrical connector having a male portion with a peripheral outer wall conforming to the IEC 320 standard, said male portion including a plurality of first electrical terminals, said first connector includes a peripheral wall surrounding said male portion, said peripheral wall and said male portion defining a recess therebetween; and a second electrical connector having a female portion with a peripheral inner wall conforming to the IEC 320 standard, said female portion including a plurality of second electrical terminals mateable with said first electrical terminals, said second connector includes a shroud defining said female portion, said shroud received within said recess, said shroud including at least one of said radial seal and said axially facing seal;

wherein at least one of said male portion and said female portion includes at least one seal, each said seal being one of a radial seal and an axially facing seal.

10. The electrical connector assembly of claim 9, wherein said shroud includes an outer wall carrying said said radial seal.

11. The electrical connector assembly of claim 10, wherein said shroud outer wall has a circular profile.

12. An electrical connector assembly, comprising:

a first electrical connector having a male portion with a peripheral outer wall conforming to the IEC 320 standard, said male portion including a plurality of female electrical terminals, said first connector including a peripheral wall surrounding said male portion, said peripheral wall and said male portion defining a recess therebetween; and a second electrical connector including a shroud defining a female portion with a peripheral inner wall conforming to the IEC 320 standard and receiving said peripheral outer wall therein, said shroud received within said recess, said shroud including at least one of a radial seal and an axially facing seal, said female portion including a plurality of male electrical terminals mating with said female electrical terminals.

13. An electrical connector assembly, comprising:

a first electrical connector having a male portion with a peripheral outer wall conforming to the IEC 320 standard, said male portion including a plurality of female electrical terminals, said outer wall including at least one of a radial seal and an axially facing seal; and a second electrical connector including a female portion with a peripheral inner wall conforming to the IEC 320 standard and receiving said peripheral outer wall therein, said female portion including a plurality of male electrical terminals mating with said female electrical terminals.

* * * * *